US006127107A

United States Patent [19]

Codling et al.

[11] Patent Number: 6,127,107

[45] Date of Patent: Oct. 3, 2000

[54] PHOTOGRAPHIC RECORDING MATERIALS AND THEIR USE IN REDOX AMPLIFICATION

[75] Inventors: Adrian J. Codling, Hertfordshire; John R. Fyson, Hackney, both of United Kingdom

[73] Assignee: Eastman Kodak Company, Rochester, N.Y.

[21] Appl. No.: 09/496,636

[22] Filed: Feb. 2, 2000

Related U.S. Application Data

[62] Division of application No. 08/994,770, Dec. 19, 1997.

[30] Foreign Application Priority Data

Dec. 19, 1996 [GB] United Kingdom ..... 9626331

[51] Int. Cl.[7] ..... G03C 1/73

[52] U.S. Cl. ..... 430/543; 430/548; 430/549; 430/552; 430/553; 430/554; 430/555; 430/556; 430/557; 430/558

[58] Field of Search ..... 430/543, 548, 430/549, 552, 553, 554, 555, 556, 557, 558

[56] References Cited

U.S. PATENT DOCUMENTS

| | | | |
|---|---|---|---|
| 4,414,305 | 11/1983 | Nakamura et al. | 430/373 |
| 4,469,780 | 9/1984 | Hirai et al. | 430/373 |
| 4,880,725 | 11/1989 | Hirai et al. | 430/373 |
| 5,110,714 | 5/1992 | Furusawa et al. | 430/376 |
| 5,200,301 | 4/1993 | Wingender et al. | 430/373 |
| 5,215,875 | 6/1993 | Matejec et al. | 430/505 |
| 5,354,647 | 10/1994 | Fyson | 430/393 |
| 5,387,499 | 2/1995 | Earle et al. | 430/399 |
| 5,670,300 | 9/1997 | Fyson et al. | 430/300 |
| 5,695,913 | 12/1997 | Nakamura et al. | 430/373 |
| 5,707,786 | 1/1998 | Schmuck et al. | 430/373 |
| 5,756,270 | 5/1998 | Fyson | 430/398 |

FOREIGN PATENT DOCUMENTS 0 722 118 A1 12/1994 European Pat. Off. .

*Primary Examiner*—Hoa Van Le
*Attorney, Agent, or Firm*—J. Lanny Tucker

[57] ABSTRACT

A photographic recording material for use in redox amplification comprises a support having thereon a plurality of emulsion layers, each emulsion layer containing a color-forming coupler, and wherein the activity of the couplers is from 45 to 70% as measured by the citrazinic acid method. These materials may be developed by a redox development step which may be followed by a bleach-fix step without any intervening step. Staining is eliminated with the use of these photographic materials.

4 Claims, No Drawings

PHOTOGRAPHIC RECORDING MATERIALS AND THEIR USE IN REDOX AMPLIFICATION

CROSS-REFERENCE TO RELATED APPLICATION

This is a Divisional of application Ser. No. 08/994,770 filed Dec. 19, 1997, now allowed.

FIELD OF THE INVENTION

This invention relates to new photographic recording materials and to a process of redox amplification in which they are used.

BACKGROUND OF THE INVENTION

Redox amplification processes have been described, for example in British Specifications Nos. 1,268,126; 1,399,481; 1,403,418; and 1,560,572. In such processes color materials are developed to produce a silver image (which may contain only small amounts of silver) and are treated with a redox amplifying solution (or a combined developer/amplifier) to form a dye image.

The developer/amplifier solution contains a color developing agent and an oxidizing agent which will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds which provide hydrogen peroxide, e.g., addition compounds of hydrogen peroxide such as perborates, and addition compounds of hydrogen peroxide with urea. Other oxidizing agents include cobalt (III) complexes including cobalt hexammine complexes; and periodates. Mixtures of such compounds can also be used.

In color photography development (whether redox or conventional) it is necessary at an appropriate stage to remove the silver image, which if left behind, would darken the dye image. Also it is necessary to remove unused silver halide because it darkens on exposure to light.

To remove the silver it has been previously proposed to convert it to silver halide with a suitable oxidizing agent known in the art as a bleach such as potassium ferricyanide or ferric iron complexed with ethylenediaminetetraacetic acid acting in the presence of potassium bromide. The two steps may be combined using a solution called a beach-fix or blix.

In the case of a bleach-fix employed after redox amplification, the solution only needs small amounts of iron (III) and thiosulfate because they have only small amounts of silver to remove.

It has been reported previously that when a bleach-fix step in which ferric iron is the oxidizing agent immediately follows redox development that dye formation continues in some layers. This is probably caused by a catalytic action of the iron in the bleach fix. This continued dye formation results in a staining of the image.

U.S. Pat. No. 5,354,647 discloses a method by which the staining can be reduced or eliminated by including a high concentration of sulfite in the bleach-fix solution. However, when the bleach-fix has become seasoned, particularly when low replenishment rates are used, the staining reappears and it has been previously proposed to include a stop or stop-fix between the developer/amplifier and the bleach-fix.

This has the disadvantage in making the processor larger and the overall process time longer.

SUMMARY OF THE INVENTION

According to the present invention, a process for the redox development of an imagewise exposed photographic recording material containing a plurality of layers, each layer containing a color-forming coupler, the process comprising subjecting the imagewise exposed photographic recording material to development/amplification in the presence of an oxidizing agent, wherein the activity of the color-forming couplers is from 45 to 70% as measured by the citrazinic acid method.

The invention also provides a photographic recording material for use in redox amplification, the material comprising a support having thereon a plurality of emulsion layers, each emulsion layer containing a color-forming coupler, and wherein the activity of the couplers is from 45 to 70% as measured by the citrazinic acid method.

The new materials of this invention enable the bleach-fix stage to immediately follow the redox development. By immediately we mean without an intervening stop bath or fix bath. This means that the overall process time can be shorter and the processor to be smaller.

A solution to the noted problems has now been found by the use in the photographic recording material of dispersions of color-forming couplers of relatively low activity which permit a bleach-fix step to immediately follow the redox development step.

DETAILED DESCRIPTION OF THE INVENTION

The bleach-fix solution preferably contains at least 0.02 and not more than 0.5 molar of a ferric iron compound as the oxidant and a mixture of thiosulfate and sulfite (or metabisulfite) in amounts such that the concentration of thiosulfate is from 0.05 to 1 molar.

Preferably the amounts of iron (III) complex and sulfite added to make up the solution are from 0.015 to 0.3 moles of iron (III) complex and from 0.05 to 0.5 moles of sulfite (or an equivalent amount of metabisulfite).

Preferably the silver halide in the photographic material is substantially all silver chloride.

Preferably the bleach-fix solution contains not more than 0.4 moles of iron (III) complex and at least 0.1 moles of sulfite per liter.

More preferred ranges are iron (III) complex from 0.10 to 0.3 moles and sulfite from 0.05 to 0.50 moles per liter.

Color developer solutions for silver chloride color papers do not contain hydroxylamine sulfate because it can act as a black-and-white developing agent and this severely inhibits dye yield. Instead, diethylhydroxylamine is used because it does not inhibit dye yield.

Conveniently the redox developer/amplifier solution used in the present invention comprises a color developing agent, hydrogen peroxide or a compound which provides hydrogen peroxide and hydroxylamine or a salt thereof and wherein the concentration ranges are:

hydrogen peroxide from 0.5 to 15 ml/l (as 30% w/w solution), hydroxylamine or a salt thereof from 0.25 to 8 g/l (as hydroxylamine sulfate), and wherein the pH is in the range from 10.5 to 12.5.

The concentration range of the hydrogen peroxide is preferably from 0.5 to 7 ml/l and especially from 0.5 to 2 (as 30% w/w solution).

The composition is preferably free of any compound that forms a dye on reaction with oxidized color developer.

For stable formulations the relative proportions of hydrogen peroxide (as ml/l of a 30% w/w solution) and hydroxylamine compound (as g/l hydroxylamine sulfate) may need to be balanced to give the required result. Because the process time is relatively short, this is optional for the redox developer/amplification solutions used in the present invention.

The photographic material may be first subjected to a development step with a developer solution containing no peroxide or other oxidizing agent before the redox amplification.

The color photographic material to be processed may be of any type but will preferably contain low amounts of silver halide. Preferred total silver halide coverages are in the range 6 to 300, preferably 10 to 200 mg/m$^2$, and particularly 10 to 100 mg/m$^2$ (as silver).

A particular application of redox amplification is in the processing of silver chloride color paper, for example, paper comprising at least 85 mole % silver chloride, especially such paper with low silver levels, for example levels below 200 mg/m$^2$ and preferably below 100 mg/m$^2$.

The material may comprise the emulsions, sensitizers, couplers, supports, layers, additives, etc. described in *Research Disclosure*, December 1978, Item 17643, published by Kenneth Mason Publications Ltd., Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

As stated above, the process of the invention is particularly suitable for use in a tank of relatively small volume and in a preferred embodiment the ratio of the tank volume to maximum area of material accommodatable therein (i.e., maximum path length times width of material) is less than 11 dm$^3$/m$^2$, preferably less than 3 dm$^3$/m$^2$.

The process may be carried out in what is known in the art as a minilab, for example, the tank volume may be below 5 liters and sometimes below 3.0 liters, conveniently in the range 1.5 to 2.5 liters and may be about 1 liter.

The material to be processed is conveniently passed through the tank and preferably the developer solution is recirculated through the tank at a rate of 0.1 to 10 tank volumes per minute. The preferred recirculation rate is from 0.5 to 8 especially from 1 to 5 and particularly from 2 to 4 tank volumes per minute.

The recirculation with or without replenishment may be carried out continuously or intermittently. In one method of working both can be carried out continuously while processing is in progress but not at all or intermittently when the tank is idle.

Replenishment may be carried out by introducing the required amount of replenisher into the recirculation system either inside or outside the processing tank.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less then 11 mm, preferably less than 5 mm and especially about 2 mm.

The shape of the tank is not critical but it may conveniently be in the shape of a shallow tray or, preferably U-shaped.

It is preferred that the dimensions of the tank be chosen so that the width of the tank is the same as or only just wider than the width of the material being processed.

The total volume of the processing solution within the processing channel and recirculation system is relatively smaller as compared with prior art processes. In particular the total amount of processing solution in the entire processing system for a particular module is such that the total volume in the processing channel is at least 40% of the total volume of the processing solution in the entire system. Preferably the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6<F/A<23$$

where F is the flow rate of the solution through the nozzle in liters/minute, and A is the cross sectional area of the nozzle provided in square centimeters.

Providing a nozzle in accordance with the foregoing relationship assures appropriate discharge of the processing solution against the photosensitive material.

Such low volume thin tank systems are described in more detail in the following patent specifications: U.S. Pat. Nos. 5,294,956; 5,179,404; 5,270,762; EP-A-559,025; EP-A-559,026; EP-A-559,027; WO 92/10790; WO 92/17819; WO 93/04404; WO 92/17370; WO 91/19226; WO 91/12567; WO 9207302; WO 93/00612 and WO 92/07301 and U.S. Pat. No. 5,436,118.

According to another aspect of the present invention, there is provided a photographic recording material for use in redox amplification which comprises a support having layers of emulsion, each layer containing a color-forming coupler and wherein the activity of the couplers is such that the dye density in the Dmax regions is reduced by 45% to 70% by the addition of 4 g/l of citrazinic acid added to the developer solution at a pH of 11.5. Preferably, the total activity of all three couplers is from 45 to 70%.

The activity of couplers can be measured by a test employing citrazinic acid (CZA) (2,6-dihydroxyisonicotinic acid) to compete with the coupler. High activity couplers will generate more dye than low activity couplers in competition with CZA. The test method involves measuring, for each coupler, the dye density in the Dmax regions produced when a paper containing the coupler is processed with a specific developer/amplifier solution. The dye density is measured with and without citrazininc acid added to the developer/amplifier solution. When the citrazininc acid is present the dye density is reduced.

An activity of 45 to 70% means that the dye density is reduced by 45 to 70% by the addition of 4 g/l citrazinic acid at a pH of 11.5.

The test method is specifically described in the following Example.

The invention is illustrated by the following Examples.

EXAMPLE 1

Six coatings were made with the following laydowns of silver (as essentially pure chloride cubic emulsions) and couplers in the light-sensitive layers. The silver laydowns are in mg/m$^2$ and the couplers in g/m$^2$. Six different couplers were used in the coating designated by Roman numerals. The remaining layer structure was similar to that of KODAK EKTACOLOR™ Edge paper with an oxidized developer scavenger (di isooctyl hydroquinone) coated at 121 mg/m$^2$ in the layers between the light-sensitive layers.

| | Ag | coupler | Ag | coupler | Ag | coupler |
|---|---|---|---|---|---|---|
| Coating Number | | 1 | | 2 | | 3 |
| red sens layer | 20 | I 0.42 | 20 | I 0.42 | 20 | I 0.42 |
| green sens layer | 19 | II 0.39 | 19 | IV 0.25 | 19 | IV 0.25 |
| blue sens layer | 40 | III 1.08 | 40 | III 1.08 | 40 | V 0.48 |
| Coating Number | | 4 | | 5 | | 6 |
| red sens layer | 20 | I 0.42 | 20 | I 0.42 | 20 | I 0.42 |
| green sens layer | 19 | IV 0.18 | 19 | II 0.39 | 19 | II 0.39 |
| blue sens layer | 40 | VI 0.60 | 40 | V 0.48 | 40 | VI 0.60 |

The structures of the couplers used were as follows:

Coupler I

Coupler I

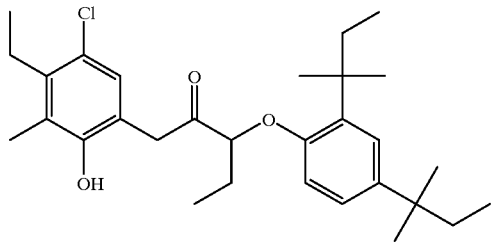

Coupler II

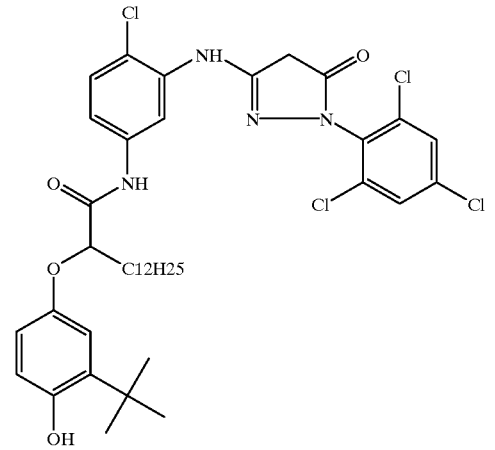

Coupler III

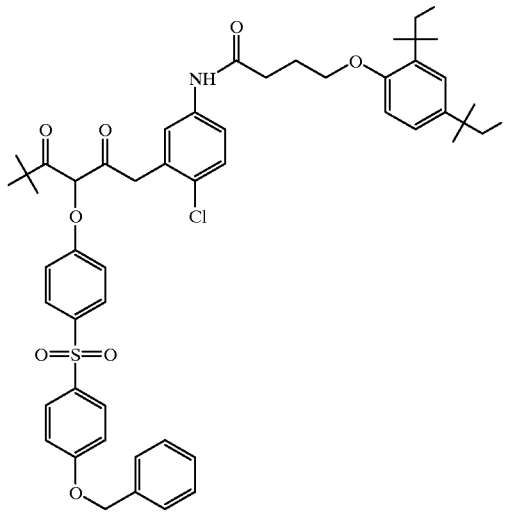

Coupler IV

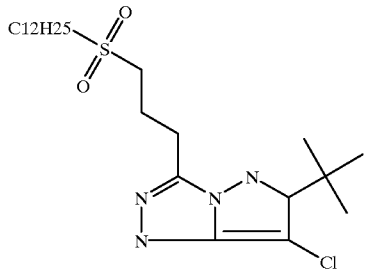

-continued

Coupler V

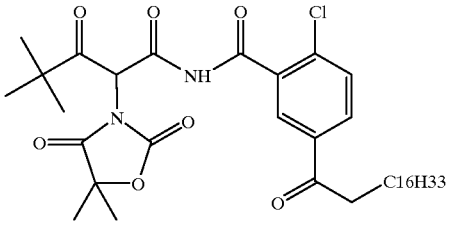

Coupler VI

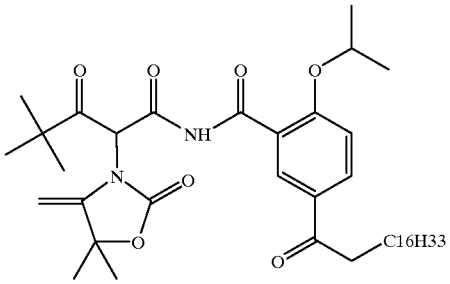

Couplers I, IV, V and VI were each dispersed in an equal weight of dibutyl phthalate and couplers II and III were each dispersed in an equal weight of tris(2-ethylhexyl) phosphate.

The following processing solutions were made up:

| Redox developer amplifier | |
|---|---|
| Sequestrant | 0.6 g |
| DTPA | 0.81 g |
| $K_2HPO_4.3H_2O$ | 40.0 g |
| KBr | 1.5 g |
| KCl | 0.45 g |
| Catechol disulfonate (solid) | 0.3 g |
| Hydroxylamine sulfate | 1.2 g |
| KOH (solid) | 10.0 g |
| color developer | 5.5 g |
| TWEEN ™ 80 (warmed) | 0.3 g |
| Dodecylamine (10%) (dissolved in TWEEN ™ ) | 1.0 ml |
| water to 1 liter | |
| pH adjusted to 11.5 with KOH (solid) | |
| $H_2O_2$ (30%) just before processing. | 2.5 ml added |

Sequestrant used in all the Examples was a 60% w/w aqueous solution of 1-hydroxyethylidene-1,1-phosphonic acid.

DTPA is diethylene triamine pentaacetic acid.

Color developing agent used in all the Examples was N-(2-(4-amino-N-m-toluidino)ethyl)-methanesulfonamide sesquisulfate hydrate.

| Bleach-fix | |
|---|---|
| sodium metabisulfite | 35 g |
| sodium thiosulfate | 25 g |
| ammonium iron (III) EDTA solution (1.56 molar) | 40 mls |
| water to 1 liter | |
| pH adjusted to 5.5 with ammonia or sulfuric acid. | |

Each of the coatings containing the different couplers was exposed to a step wedge and processed in small manual processing tanks through the following process at 35° C.

| | |
|---|---|
| Develop | 45 seconds |
| Blix | 45 seconds |
| Wash | 90 seconds |

Dry at room temperature

The experiment was repeated with each coating with 4 g/l citrazinic acid (CZA) added to the developer.

The strips were measured using an X-rite densitometer and Table 1 shows the Dmin (stain) of the coatings processed in the developer without CZA. All coatings in this experiment have a cyan coupler in the red-sensitive layer of structure I.

TABLE 3

| coating number | magenta coupler | yellow coupler | Red Dmin | Green Dmin | Blue Dmin |
|---|---|---|---|---|---|
| 1 | II | III | 0.087 | 0.119 | 0.089 |
| 2 | IV | III | 0.087 | 0.098 | 0.089 |
| 3 | II | V | 0.094 | 0.120 | 0.083 |
| 4 | IV | V | 0.094 | 0.105 | 0.088 |
| 5 | II | VI | 0.101 | 0.127 | 0.095 |
| 6 | IV | VI | 0.098 | 0.107 | 0.090 |

These results show that the coupler II causes the most stain and the others give relatively stain free results.

Table 4 shows the Dmaxes of the coatings processed with and without the addition of 4 g/l of CZA. Also included is the percentage reduction in the Dmax density caused by the addition of the CZA.

TABLE 4

| | Red DMax | | | Green Dmax | | | Blue DMax | | |
|---|---|---|---|---|---|---|---|---|---|
| coating No | no CZA | with CZA | % Dmax loss | no CZA | with CZA | % Dmax loss | no CZA | with CZA | % Dmax loss |
| 1 | 2.45 | 1.15 | 53 | 2.70 | 2.01 | 26 | 2.23 | 1.15 | 48 |
| 2 | 2.52 | 1.30 | 48 | 2.65 | 1.30 | 51 | 2.25 | 1.05 | 53 |
| 3 | 2.60 | 0.97 | 63 | 2.08 | 1.24 | 40 | 2.18 | 0.90 | 58 |
| 4 | 2.46 | 0.85 | 65 | 2.33 | 0.93 | 60 | 2.21 | 0.90 | 59 |
| 5 | 2.78 | 1.20 | 57 | 2.75 | 1.78 | 35 | 2.41 | 1.21 | 50 |
| 6 | 2.79 | 1.21 | 57 | 2.69 | 1.42 | 47 | 2.45 | 1.25 | 49 |

By inspection of both the above Tables it can be seen that the highest Dmins are associated with those couplers with the least reduction of Dmax density in the presence of CZA.

Where the reduction in density is less than 45%, especially for the coupler with the structure II, there is a tendency for high stain in a system with an RX developer immediately followed by a blix. However, for those couplers where the Dmax density of a particular layer in a coating is reduced by 45% by the addition of 4 g/l of CZA to the developer, the stain in that layer is similar to the base density.

The invention has been described in detail with particular reference to certain preferred embodiments thereof, but it will be understood that variations and modifications can be effected within the spirit and scope of the invention.

What is claimed is:

1. A photographic recording material for use in redox amplification, said material comprising a support having thereon a plurality of emulsion layers, each emulsion layer containing a color-forming coupler, and wherein the activity of the couplers is from 45 to 70% as measured by the citrazinic acid method.

2. The photographic recording material of claim 1 comprising yellow, magenta and cyan couplers in different layers, and the total activity of all three couplers is from 45 to 70%.

3. The photographic recording material of claim 1 containing less than 200 $mg/m^2$ of silver.

4. The photographic material of claim 3 wherein the silver halide is substantially all silver chloride.

* * * * *